United States Patent [19]

Vosper et al.

[11] Patent Number: 4,462,795

[45] Date of Patent: Jul. 31, 1984

[54] METHOD OF OPERATING A WALL FIRED DUCT HEATER

[75] Inventors: Ralph R. Vosper, San Jose, Calif.; Arie W. Spoormaker, Maassluis, Netherlands; Chester S. Binasik, Palo Alto, Calif.; Norman E. Harthun, San Carlos, Calif.

[73] Assignee: Coen Company, Inc., Burlingame, Calif.

[21] Appl. No.: 460,202

[22] Filed: Jan. 24, 1983

Related U.S. Application Data

[60] Division of Ser. No. 182,249, Aug. 28, 1980, Pat. No. 4,375,952, which is a continuation-in-part of Ser. No. 073,348, Sep. 7, 1979, Pat. No. 4,286,945.

[51] Int. Cl.[3] ..... F24H 7/00; F24H 1/00; F23D 13/24; F23D 15/00

[52] U.S. Cl. ..... 432/29; 431/350; 431/351; 432/222

[58] Field of Search ..... 432/29, 222; 431/350, 431/351

[56] References Cited

U.S. PATENT DOCUMENTS

| | | | |
|---|---|---|---|
| 3,366,373 | 1/1968 | Reed | 60/39.182 |
| 3,494,712 | 2/1970 | Vosper et al. | 431/171 |
| 3,649,211 | 3/1972 | Vosper | 431/350 |
| 3,830,620 | 8/1974 | Martin | 431/350 |
| 3,958,922 | 5/1976 | Goodnight et al. | 432/222 |
| 3,995,991 | 12/1976 | Wilkinson | 432/222 |

*Primary Examiner*—John J. Camby
*Attorney, Agent, or Firm*—Townsend and Townsend

[57] ABSTRACT

A heater for heating gases such as turbine exhaust gases to facilitate the extraction of the heat energy carried by such gases or flue gases to reduce their corrosiveness. The heater is defined by burners installed on walls of the duct through which the gases flow. The burner can be operated with heavy fuel oil and normally uses no more primary air than is necessary to ignite the fuel oil atomized by the burner and sustain a flame. The flame is relatively long and narrow and is directed transversely to the gas flow into the duct. Upstream of the burner is a shield to protect the flame from the gas flow. The shield communicates with a register which collects an amount of gas sufficient to provide the balance of the combustion oxygen to fully combust all fuel. From the register the gas flows along inclined passages to the side of the shield facing the flame, the passages directing the gas in the direction of the flame and at an oblique angle in regard thereto. The flame shield is shaped to approximate the outline of the flame. Gas not collected by the register is guided by the shield past the flame so as to achieve a uniform heating of the gas and thereby prevent the formation of hot spots in the gas downstream of the heater. For operation in gas streams having a low oxygen content the burner is constructed so that the fuel-to-combustion oxygen ratio in the upstream and downstream portion of the flame (relative to the exhaust gas flow) is substantially equalized.

3 Claims, 15 Drawing Figures

METHOD OF OPERATING A WALL FIRED DUCT HEATER

RELATED APPLICATIONS

This is a Division of Application Ser. No. 182,249, filed Aug. 28, 1980, now U.S. Pat. No. 4,375,952, which is a Continuation-in-Part of Ser. No. 073,348 filed Sept. 7, 1979, now U.S. Pat. No. 4,286,945.

BACKGROUND OF THE INVENTION

The present invention relates to heaters for heating a stream of gas, such as relatively hot turbine exhaust gas or relatively cool flue gases.

It is well-known that exhaust gases in general and turbine exhaust gases in particular have a relatively high temperature. If such gases are discharged to the atmosphere, a large amount of energy is wasted. To effectively utilize the energy carried by such gases, say for the generation of steam, it has been proposed to heat the gases to raise their temperature. That steam can then in turn be employed to power steam turbines or for other advantageous uses. Some flue gases, on the other hand, need to be heated before they are discharged when the gases include chemicals which become corrosive below certain temperatures.

The term "exhaust gas" is used herein to designate a gas which typically has an elevated temperature, i.e. gas of a temperature higher than ambient temperature, and which further has an oxygen content less than that of air although the actual temperature of such gases and their oxygen content may vary widely. For example, turbine exhaust gases may have temperatures of as much as 500° C. or more (and an oxygen content as high as 16% or more while scrubbed flue gases may have a temperature below 100° C. and an oxygen content of as little as 2–3%.

In the past, exhaust gases have been heated in a variety of ways. The most inexpensive way to heat exhaust gases, at least as far as the construction of the heater is concerned, is to employ natural gas or light oil burners which are conveniently placed inside the exhaust gas duct. Examples of such heaters are disclosed in U.S. Pat. Nos. 3,632,286 and 3,830,620.

The increasing scarcity of gas and high quality, e.g. highly refined, light weight fuel oil has made it necessary to use heavy oils such as No. 6 fuel oil for the operation of gas turbines. This dictates that exhaust gases be heated with the same heavy oils. U.S. Pat. No. 3,934,553 illustrates such an exhaust gas heater. Briefly, it provides that the burners, including their fuel nozzles, be mounted exteriorly of the exhaust gas duct so that the fuel and the nozzle are never directly exposed to the hot exhaust gases. In this manner, a potential clogging of the fuel lines to the nozzle due to an excessive heating thereof by the exhaust gas is prevented. Thus, the flame is formed at the wall of the duct and is projected towards the center thereof into the flow of hot exhaust gas. To prevent the flame from being extinguished by the exhaust gas flow, a flame shield is positioned immediately upstream of the burner so as to form a trough within which the flame can burn in a manner analogous to protecting a candle from being blown out by shielding it with one's arched hand against air drafts.

For maximum efficiency, it is desirable that as little outside air as possible be introduced into the duct to sustain the flame since such outside air proportionally cools the gas flow and since the purpose of the heater is to raise the exhaust gas flow to the desired level at which the heat energy in the gas can be used to generate steam, for example. Accordingly, the burners appear to operate with relatively low primary air, i.e. outside air mixed with the fuel in the burner and the U.S. Pat. No. 3,934,553 patent discloses to perforate the shield by including holes and passages therein which permit the flow of part of the exhaust gas "through" the shield to the flame so that combustion oxygen for the flame can be extracted from the exhaust gas.

A difficulty with this approach is that the burner becomes quite unresponsive to regulation, that is if the perforations in the shield are formed so as to provide the flame with sufficient oxygen for maximum operation, the perforations typically flow an excessive amount of exhaust gas to the flame when it operates in a turn-down mode. In fact, at that point, too much exhaust gas may penetrate the flame shield and the flame may become extinct. Thus, such heaters are not well adapted for use over a wide operating range.

Moreover, heaters of the type disclosed in the U.S. Pat. No. 3,934,553 have a tendency to unevenly heat the exhaust gas so that the gas downstream of the heater may exhibit hot spots which, in turn, may lead to a local overheating of the heat exchange surfaces over which the gas subsequently flows. Such uneven heating is the result of the provision of spaced apart shields which are formed so as to define a protective trough for a particular portion of the flame, typically its base proximate the burner where the flame is the widest. As the flame narrows towards its end, its tranverse dimension becomes less and less, yet the protective shield forms a barrier with the same cross-section as in the vicinity of the flame base. As a result, exhaust gas streaming through the center of the duct is heated relatively less than exhaust gas streaming past the sides of the duct on which the burners are mounted so that the center portion of the gas stream may become less heated than the peripheries thereof. This can adversely affect the overall operation of the duct heater and the associated heat exchange surfaces.

Thus, the most recent prior art exhaust gas heater seeks to devise a heater which can be operated with lower grade, heavier fuel oils instead of with the much more expensive and increasingly scarce light weight fuel oils and/or fuel gas. To avoid the clogging of fuel lines from the coking of the overheated heavy fuel oils, the burners were essentially mounted outside the exhaust gas duct and shields were provided to protest the flames.

Although flame shields of this type in general are nothing new and were previously employed to protect the flames of gas fired duct heaters, as is disclosed in U.S. Pat. Nos. 3,494,712 and 3,649,211 to Vosper and assigned to the assignee of the present application, the flame shields employed in connection with exhaust gas heaters of the type described in the above-referenced U.S. Pat. No. 3,934,553 simply constituted shields which were formed with only one function in mind, namely to serve as an anchor for the flame in the exhaust gas stream so as to prevent it from being blown in a downstream direction. However, for an efficient operation of the burner and a minimization of atmospheric pollution more is required of such shields since the shields, when placed in an exhaust gas stream, act as baffles or guides for the exhaust gas which channel the gas along numerous paths essentially about and past the flames of the heater. Thus, the shields can induce eddies on their downstream side which, if not controlled, can lead to an accumulation of carbon, soot and the like which can ultimately be discharged to the atmosphere and cause pollution; the shields determine how close the various exhaust gas streams come to the flame and, thereby, how evenly or unevenly the gas will be heated which, if not controlled, may lead to hot spots in certain portions of the gas flowing downstream of the heater and thus may damage heat exchange surfaces located there; and, most importantly, the shield and the above-discussed perforations determine to what extent and how combustion oxygen for the flames of the heater from sources other than outside air is supplied to them—in this regard, closest control is necessary if a complete and efficient combustion of all fuel is to be assured during all operating conditions of the burner.

The exhaust gas heater of the U.S. Pat. No. 3,934,553 does not take into account these aspects. As a result, the heater disclosed in the U.S. Pat. No. 3,934,553 patent is only fully satisfactory insofar as it is capable of heating the exhaust gases with heavy fuel oils without requiring the frequent cleaning of the burner and in particular its fuel supply lines. Its operating characteristics, operating range and efficiency, however, are less than fully satisfactory. Thus, there is presently a need for an exhaust gas heater capable of using heavy fuel oils which eliminates or at least significantly reduces the drawbacks encountered with prior art heaters of this type.

In addition, the exhaust gas heater disclosed in U.S. Pat. No. 3,934,553 relies on the oxygen in the exhaust gas stream for a substantial portion of the combustion oxygen required by the flame of the burner. Although sufficient combustion oxygen is normally available from turbine exhaust gases, that is not the case with other types of exhaust gases such as flue gases which may have a little as 2 to 3% of oxygen. In such instances, the combustion oxygen must be provided by combustion air, both primary air introduced by the burner and secondary combustion air introduced over the length of the flame. Since the environment within which the flame burns is effectively devoid of oxygen, it is difficult to achieve complete combustion. Yet, incomplete combustion leads to the discharge of pollutants which is unacceptable under today's strict pollution control laws and regulations. Duct burners capable of operating under such conditions are presently unavailable.

SUMMARY OF THE INVENTION

The present invention provides an exhaust gas heater operable with heavy fuel oils which, as was the case with prior art heaters of this type, has burners mounted to the wall of the exhaust gas duct. However, in contrast to the prior art, it utilizes flame shields to anchor the flames which are constructed so as to assure a substantially uniform heating of all portions of the exhaust gas, which allows a precise control of the amount of combustion oxygen fed to the flame either directly from the exhaust gas or, if that contains insufficient oxygen, wholly or partially with oxygen supplied from ambient air. The shield is further constructed so as to substantially eliminate all eddies on the downstream side of the shield to thereby essentially eliminate a buildup of carbon and soot which, if uncontrolled, can lead to the discharge of undesirable pollutants into the atmosphere.

The exhaust gas heater of the present invention is adapted to efficiently operate in very low oxygen environments, e.g. in the above-mentioned flue gases having an oxygen content as little as 2 to 3%. It is capable of cooling the flame shield and any equipment, such as an air plenum, attached thereto which is of importance under certain circumstances as, for example, in flue gas reheat installations to prevent the build-up of mineral and other deposits on excessively hot surfaces of the shield, the plenum and the like. In such instances sufficient air is introduced through the plenum and the shield to achieve the desired cooling effect. Frequently, this requires that as much as 100% of the theoretically required or stoichiometric air is provided as "secondary combustion air". In addition, primary combustion air is introduced through the burner and to assure that all fuel particles are fully combusted in the vicinity of the flame shield and before they migrate into the oxygen deficient exhaust gas environment downstream of the shield the burner includes means for substantially equalizing the fuel-to-combustion oxygen ratio in an upstream and downstream portion (in relation to the gas flow) of the flame.

Further, the heater of the present invention employs a burner especially adapted for use with heavy oils which forms a long, relatively narrow, pencil-shaped flame which extends as far as possible from the duct wall into the duct interior. This burner forms a flame which extends sufficiently deep into the duct so that for narrow ducts, it can span the entire width thereof, while for relatively wide ducts pairs of oppositely mounted burners form flames which extend from opposite walls to about the center of the duct so as to minimize large cross-sectional areas of the duct in which no flame is present and where, therefore, exhaust gas might be insufficiently heated.

In addition, the flame shield is constructed so that exhaust gas utilized as the supply of combustion oxygen for the flame is deflected in the direction of the flame so that it impinges thereon at an oblique angle relative to the axis of the flame. In this manner, the exhaust gas does not have the tendency of blowing the flame in a downstream direction but rather tends to lengthen the flame in a direction transverse to the exhaust gas flow which aids the uniform heating thereof.

Generally speaking, an exhaust gas heater constructed in accordance with the present invention has burners mounted to opposing walls of the duct. Depending on the overall duct width, the burners on opposing duct walls are either aligned (for relatively wide ducts) or they are staggered and interleaving (for relatively narrow ducts in which the flames can extend substantially fully across the full width thereof). A flame shield is mounted to the wall upstream of the burner and it extends generally parallel to the flame into the duct. It has an outline, that is a lateral extent perpendicular to the exhaust gas flow through the duct, which approximates the outline of the flame. Thus, the shield has a relatively wide base proximate the burner (in the vicinity of the base of the flame) and it is relatively narrow adjacent a free end of the shield remote from the burner.

Depending on the overall length of the shield, which in turn depends at least in part on the width of the duct, the longitudinal shield edges are either tapered over their entire length or for long shields, a portion of the shield adjacent its base has parallel edges. In the latter instance the edges are tapered from a point spaced from the duct wall to which the shield base is mounted.

The shield is integrally constructed with a register disposed immediately upstream of the shield and in fluid communication with passages extending through the shield so that combustion oxygen can be supplied to the flame from the register. The register itself includes an opening disposed in the duct and facing in an upstream direction so that exhaust air can flow into the register. The opening includes suitable damper plates for regulating the amount of exhaust gas that can flow into the register to thereby regulate the amount of combustion oxygen supplied to the flame . This enables one to accurately regulate and control the supply of combustion oxygen over the operating range of the burner.

In one embodiment of the invention, the register can be connected with an alternative air supply, or it may be solely connected with a combustion air supply for instances in which the exhaust gas carries insufficient oxygen or where such a construction is otherwise desirable. The latter arrangement is particularly adapted for instances in which the exhaust gas is a flue gas which may have an oxygen content of as little as 1%.

The passages which communicate the register with the downstream (flame) side of the shield are preferably obliquely inclined relative to the axis of the flame by an angle of no more than 45° and preferably by an angle as small as 30° so that the exhaust gas or air supplied to the flame flows in the direction of the flame and thereby lengthens the flame for the above-discussed advantages.

In the preferred embodiment of the invention, the flame shield itself is mounted to a suitable support such as a pipe spanning across the duct and its outline facing the exhaust gas stream is generally trapezoidal that is relatively wide at the base (with or without a base section having parallel edges as above-discussed) and relatively narrow at the free of the shield in conformity with the outline of the flame. Moreover, in cross-section, the flame shield preferably has a V-shaped configuration which terminates in flow directing plates which are substantially parallel to the gas flow between the plates to substantially reduce or eliminate turbulence in the exhaust gas flow past the shields. This substantially reduces or eliminates the formation of eddies on the flame side of the shield which, in turn, prevents carbon, soot and the like deposit on that side.

The transverse extent of the flame shield is selected so that it is slightly less than the corresponding transverse extent of the flame. As a result, peripheral portions of the flame protrude past the flame shield into the (projections of) the paths for the exhaust gas between the flame shields and over the entire length of the shields. Uniform heating of all portions of the exhaust gas stream is thereby obtained. For relatively wide exhaust gas ducts in which burners mounted to opposite duct walls are aligned so that their flames terminate proximate the center of the duct generally diamond-shaped baffle plates can be provided so as to reduce the amount of gas flowing through that center section where otherwise relatively less heating would take place. A relative underheating of the central portion of the gas flow in even wide ducts is thus prevented.

The above-described exhaust gas heater has excellent operating characteristics. The nozzle, though fired with heavy fuel oil and low pressure air, as is more fully discussed below, has a turn down ratio of up to 10:1 while maintaining a flame temperature of at least about 870° C. and operating with exhaust gases having a temperature range of between about 250° C. and 530° C. (with correspondingly varying amounts of oxygen in the exhaust gas). Since the supply of exhaust gas to the flame via the register and the shield passages can be modulated irrespective of the exhaust gas flow rate the burner itself can be fired with a minimum amount of primary air, typically in the range of no more than about 10 to 15%, all other oxygen being taken directly from the exhaust gas. Thus, the heater requires relatively little air for operation over its full operating range and exhibits a high efficiency irrespective of the burner load, i.e. irrespective of the turndown ratio at which the burner is fired. Yet, the heater is quickly converted for operation with air only, should that become necessary, by directing air into the register and closing the register to the exhaust gas stream.

The present invention makes it further possible to alternatively operate the duct heater with fuel oil or with gas. Although gas operation is normally no longer desirable, under certain circumstances and especially in certain locations where gas might be readily and inexpensively available the ability of the heater to operate with alternative fuels might be highly advantageous.

When the exhaust gas heater is utilized for heating exhaust gases having a low oxygen content, and particularly in instances in which such gases are relatively hot and require a cooling of the flame shield to prevent mineral deposits and the like thereon, the present invention provides a heater which includes a flame shield defining a passage extending therethrough and a plenum on the upstream side of the shield for supplying secondary combustion air. The exhaust gas heater includes means for substantially equalizing the fuel-to-combustion oxygen ratio in an upstream portion and in a downstream portion of the flame in relation to the gas flow to effect a substantially uniform and complete combustion of the fuel discharged by the burner.

This equalizing means can take the form of a burner adapted to discharge the fuel eccentrically with respect to the axis of the burner so that a greater portion of the discharged fuel is in the upstream portion of the flame than in the downstream portion thereof. Alternatively, the equalizing means may comprise means for directing relatively more primary combustion air from the burner into the downstream portion of the flame than into the upstream portion thereof. Of course, both alternatives can be combined to enhance the amount of combustion oxygen that is available in the downstream portion of the flame.

Specifically, in one preferred embodiment of the invention, means is coupled to the plenum attached to the flame shield for supplying as secondary combustion air substantially 100% of the air that is theoretically required by the entire flame. This secondary air flows through the above-mentioned passage into contact with the upstream portion of the flame. Further, in this embodiment the burner includes means cooperating with the means for flowing the primary combustion air for supplying the upstream portion of the flame with primary combustion air in an amount comprising as much as 95% of the air that is theoretically required by the upstream portion of the flame.

This results in a thorough mixing of the fuel discharged by the burner with the primary and secondary combustion air. The substantial amount of excess air provided as secondary combustion air assures both a complete combustion of the fuel in the downstream portion of the flame and the availability of additional oxygen which is available to facilitate the complete combustion of all fuel particles in the upstream portion of the flame. In this manner, virtually no fuel particles are allowed to escape into the oxygen deficient gas stream where they would otherwise constitute highly undesirable pollutants.

This arrangement not only assures a complete and effective combustion of all fuel but further provides sufficient cooling for the flame shield and the air plenum attached thereto to prevent the deposit of contaminants thereon as well as possible structural damage to either or both which might result from excessively high exhaust gas temperatures.

Consequently, the present invention provides an exhaust gas heater which is ideally suited for today's operating environments and available heating fuels. It is thus ideally suited for heating turbine exhaust gases (with a relatively high oxygen content) so that such gases can be used for secondary steam generation or low oxygen content, relatively cool flue gases to reduce or eliminate their corrosiveness.

DESCRIPTION OF THE PREFERRED EMBODIMENTS

Figure 4:
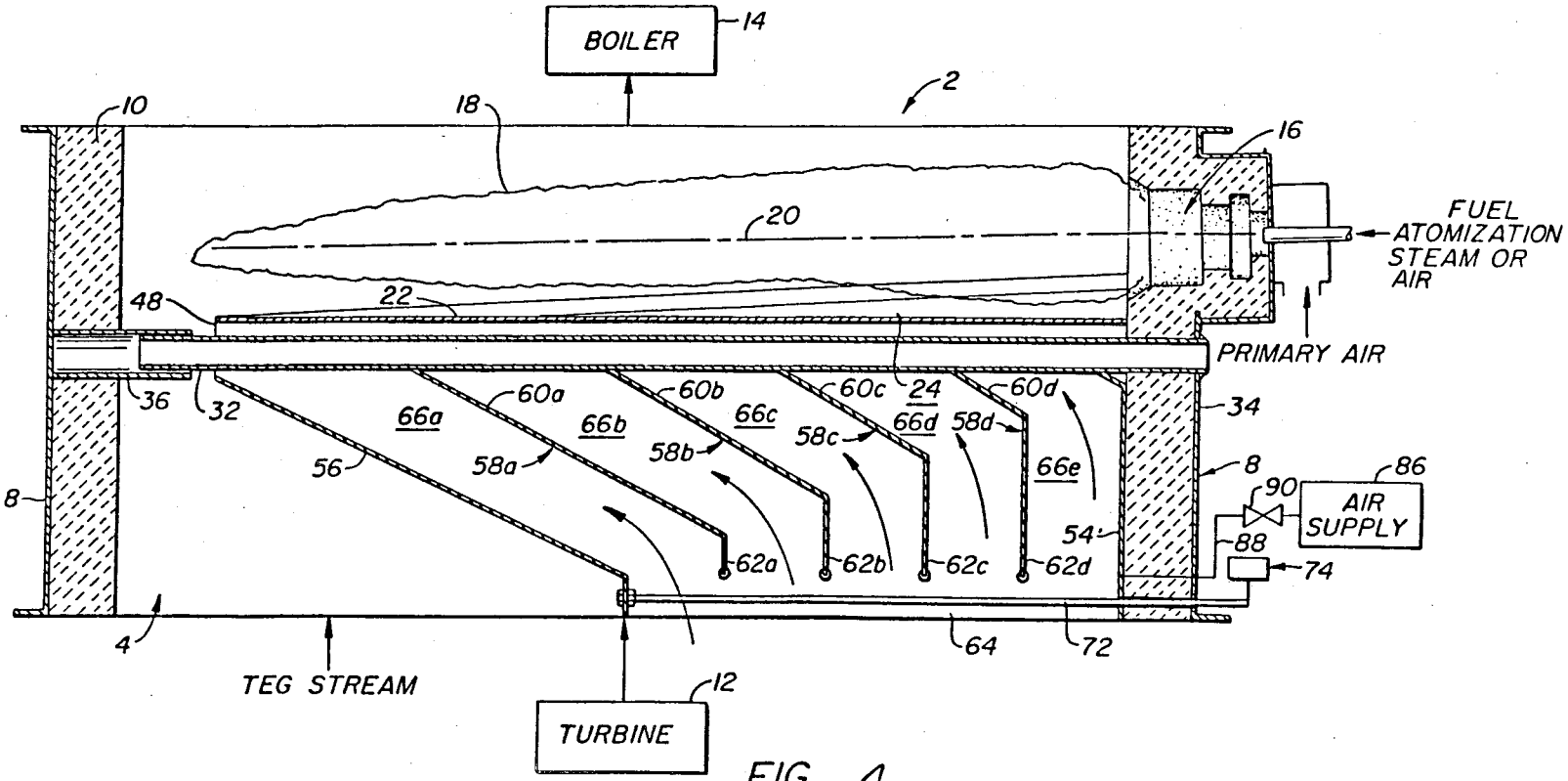
FIG. 4 is a plan view, in section, of the flame shield and the register illustrated in FIGS. 2 and 3.

Referring to FIGS. 1–4, an exhaust gas heater 2 constructed in accordance with the present invention is installed in a duct 4 through which the exhaust gas, for example turbine exhaust gas (TEG) flows in a downstream direction as is indicated by the arrow in FIG. 4. The duct is defined by parellel upper and lower horizontal duct walls 6 which are interconnected by a pair of opposing upright duct walls 8. The duct is conventionally lined with refractory bricks 10. Exhaust gas from a turbine 12, for example, flows towards the heater at a temperature which typically ranges between about 250° C. and 530° C. The heater raises the exhaust gas temperature, preferably to at least about 870° C. and frequently to as much as 1000° C. and the heated exhaust gas then contacts suitable heat exchange surfaces such as the pipes (not shown) of a boiler 14 to generate steam, for example, while the exhaust gas is cooled down to a temperature at which no further heat can be economically extracted from it. The gas is then conventionally discharged to the atmosphere.

Figure 1:
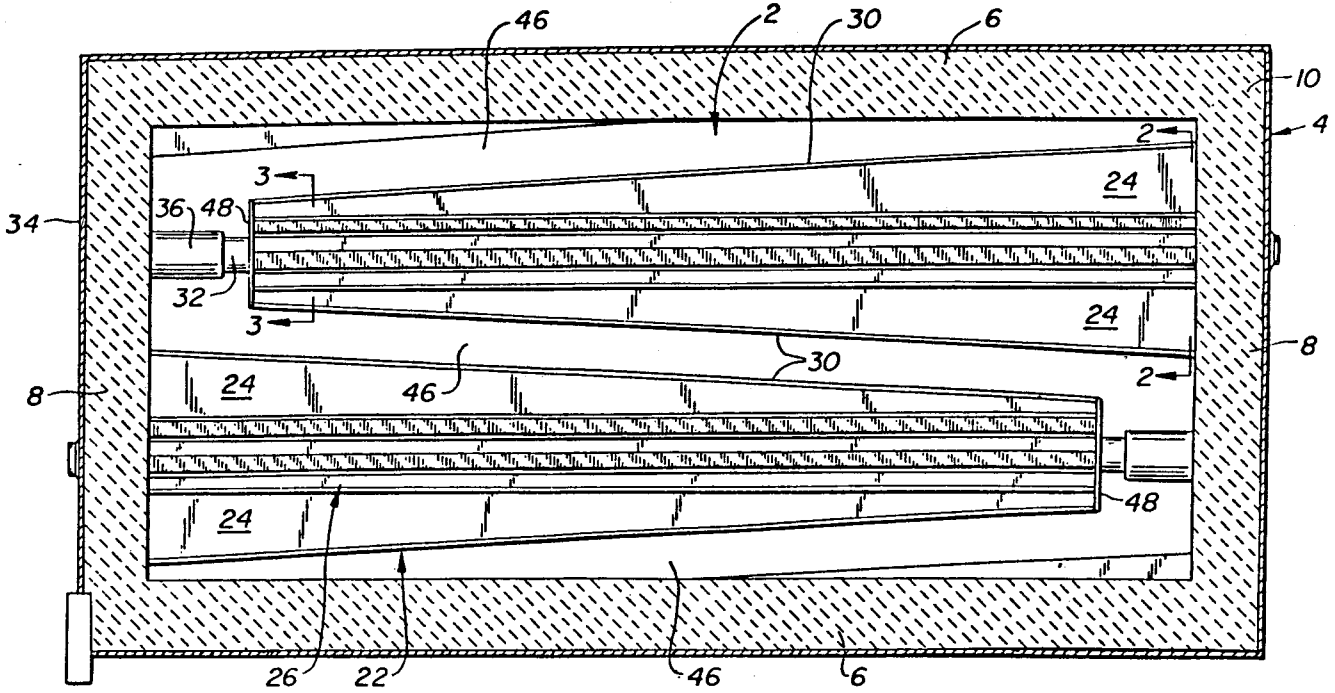
FIG. 1 is a cross-sectional view through a relatively narrow exhaust gas duct fitted with an exhaust gas heater constructed in accordance with the present invention.
Figure 3:
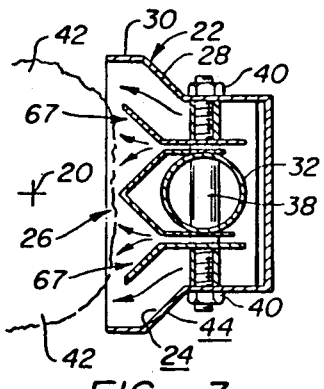
FIG. 3 is a view similar to FIG. 2 and is taken along line 3—3 of FIG. 1 proximate a free end of the shield which is remote from the associated burner.

The exhaust gas heater 2 principally comprises burners 16 which are constructed as further described below and which generate an elongated, relatively narrow, pencil-shaped flame 18 that extends along the burner axis 20 transversely to the TEG stream from one upright burner wall 8 towards the opposite duct wall. For relatively narrow duct walls the flame may be sufficiently long to extend substantially completely across the width of the duct as is illustrated in FIGS. 1 and 4. In such a case, the burners are mounted in a common place (which is perpendicular to the TEG stream) and they are staggered or offset with respect to each other as is apparent from FIG. 1.

A flame shield 22 is associated with each burner and is positioned upstream thereof so as to define on a downstream or flame side 24 of the shield a trough 26 within which the flame burns and where the flame is protected from the TEG stream so that the flame, instead of being deflected towards the boiler or extinguished by the stream can burn and form a flame pattern or outline as generated by the burner without interference from the TEG stream.

In the preferred embodiment of the invention, the shield is defined by a pair of angularly inclined shield plates 28 which diverge in a downstream direction (see FIG. 2) and which terminate in spaced apart guide plates 30 which are parallel to the TEG flow direction through the duct. A pipe 32 is mounted to the duct, preferably by affixing, e.g. welding one end of the pipe to a suitable member of the duct such as an exterior duct plate 34 while supporting the other end of the pipe in a sleeve 36 projecting from the opposite duct wall which permits the pipe to thermally expand and contract. Upright studs 38 are distributed over the length of the pipe and they, together with nuts 40 secure the inclined shield plates to the pipe so that the pipe positions and supports the flame shield in the duct at the desired location and orientation.

The elongated flame 18 has a pencil-shaped configuration as is schematically illustrated in FIG. 4 and it has its largest diameter in the vicinity of its base proximate burner 16 and its smallest diameter at its opposite end. To assure a thorough yet uniform heating of the exhaust gas it is desirable that the flame shield be constructed so that peripheral portions 42 of the flame (see FIGS. 2 and 3) project beyond guide plates 30. As a result, in use when the TEG stream flows over the upstream side 44 of the flame shield and through the path 46 between adjacent flame shields, the stream intersects the peripheral flame portions and a maximum heat transfer takes place.

Since the flame diameter decreases from its base portion (proximate the burner) to its end and to assure a substantially uniform contact between the exhaust gas stream and the peripheral flame portions, the transverse extent of the shield facing the gas stream or, as viewed in FIG. 1 the height of the flame shield decreases correspondingly so that the guide plates 30 of the flame shield converge towards a free end 48 of the shield and the entire flame shield has a trapezoidal outline relative to the gas stream as is best seen in FIG. 1.

A register 50 is positioned upstream of flame shield 22 and is defined by a pair of spaced apart plates 52 which extend rearwardly from an end of the inclined shield plates 28 and which may be integrally constructed therewith. A side of the register proximate the base of the flame is defined by a plate 54 which abuts the refractory lining of the adjoining wall 8 while another side 56 of the register proximate the free end 48 of the shield is defined by a plate 56 which is angularly inclined relative to frame axis 20 by an angle of no more than about 45° and preferably by an angle of as little as 30°.

A plurality of intermediate baffles 58*a* through *d* are suitably affixed to the horizontal register plates 52 and distributed between register sides 54 and 56. Each of the baffles includes an angularly inclined portion 60*a* through 60*d* which is parallel to angularly inclined register side 56 and a portion 62*a* through 62*d* which is parallel to straight register sides 54. The straight baffle portion terminates short of an open register exhaust gas intake 64 which faces in an upstream direction relative to the gas stream through duct 4. Consequently, when exhaust gas flows through the duct, a portion thereof enters the register through the intake and then flows through passages 66*a* through 66*d* defined by baffles 58 from the intake at an obliquely inclined angle relative to the burner axis 20 into the trough 26 defined by the flame shield. As is more fully discussed below, oxygen carried by the exhaust gas is utilized to combust the fuel dispersed into the trough by burner 16 so that the burner can be operated with very little primary air.

To assure that the exhaust gas entering the trough through passages 66 is intimately mixed with the flame and contacts all non-combusted fuel droplets, generally V-shaped diffusers 67 are provided. The diffusers extend from passages 66 into the trough and they include upwardly and downwardly inclined wings 69 which diffuse the exhaust gas towards inclined plates 44 of flame shields 22.

To regulate the amount of oxygen supplied to the flame via passages 66 in conformity with the (variable) rate with which fuel is dispersed into flame shield trough 26 by burner 16, the intake 64 of register 50 is provided with dampers 68 such as a pair of vanes 70 rotatably mounted to spaced shafts 72 which may be pivoted from the exterior of the duct via a (schematically illustrated) mechanism 74 so that more or less exhaust gas can be admitted to the register depending upon the load under which the burner operates at any given moment.

Figure 5:
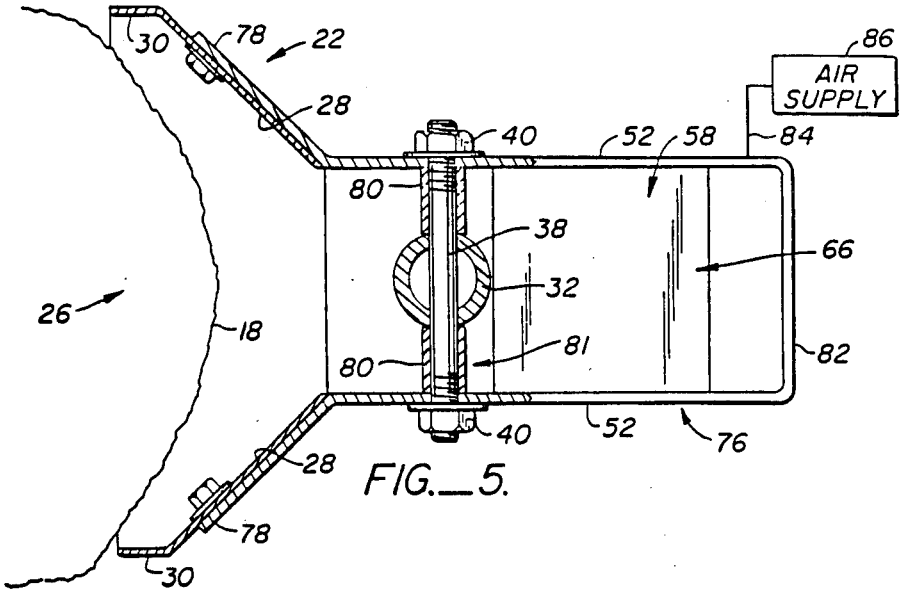
FIG. 5 is a cross-sectional view, similar to FIG. 2, of another flame shield and register constructed in accordance with the present invention.

Referring momentarily to FIG. 5, in an alternative embodiment of the invention, a combustion air register 76 may be substituted for the exhaust gas register 50 illustrated in FIGS. 1–4. The combustion air register is similarly constructed and is again defined by upper and lower, generally horizontal plates 52 which are contiguous with inclined flame shield plates 28 although in the illustrated embodiment the flame shield plates are shown to be independent of the register plates and bolted or otherwise affixed to inclined register stubs 78. The flame shield again includes guide plates 30 which are parallel to the exhaust gas streaming through the duct and they form a part of the trough 26 within which flame 18 burns. Studs 38 again secure the register and the flame shield to a support pipe 32 traversing the duct.

Spacers 80 are placed over the studs to maintain the desired flow spaces 81 between the periphery of the pipe and the horizontal register plates 52 and to thereby communicate the interior of the register via passages 66 (constructed as above discussed) with trough 26.

In contrast to the register shown in FIGS. 1–4, however, the upstream facing side of register 76 shown in FIG. 5 is closed with an end wall 82 so that no exhaust gas can enter the register. Instead, the register is connected via suitable conduits 84 which extend through the duct walls (not shown in FIG. 5) with a supply 86 of combustion air, e.g. a combustion air fan. In this manner, the combustion oxygen for maintaining the flame in the trough 26 is obtained from air. Although the efficiency of a heater constructed as illustrated in FIG. 5 is reduced because substantial amounts of (cold) air must be heated, this embodiment of the invention is ideally suited for applications in which the exhaust gas might have too little or no oxygen, e.g. for heating low oxygen content flue gases.

Referring again to FIGS. 1–4, in another alternative register 50 may be connected with air supply 86 via (schematically illustrated) conduits 88 extending through the duct wall 80 and a valve 90 so that the exhaust gas may be augmented with combustion air from the air supply in instances in which the exhaust gas includes insufficient oxyge. Further, this arrangement permits the operation of register 50 with either exhaust gas or with air by correspondingly closing and opening register dampers 68 and air valve 90 so that the fuel disbursed into the flame trough 26 by the burner 16 can be effectively and efficiently combusted irrespective of the oxygen content and/or temperature of the exhaust gas, the rate with which fuel is dispersed by the burner, etc. In this manner, the heater of the present invention can be operated over a very wide operating load range which may vary by a factor of as much as 1:10.

For best results, the flame shield 22 is positioned relative to the burner axis 20 so that the distance between the burner axis and the flame shield in the vicinity of the burner is only slightly larger than one-half the diameter of the flame when the burner is operating at full load to avoid direct contact between the flame periphery and the shield while bringing the two together as closely as practical. Further, the guide plates 30 are spaced apart so that their distance over substantially the full length of the flame shield is less than the corresponding diameter of the flame by about 1 to 3 inches so that the flame periphery protrudes into the exhaust gas paths 46 by approximately $\frac{1}{2}$ to $1\frac{1}{2}''$.

The operation of the exhaust gas heater 2 of the present invention should now be apparent. To briefly summarize it, heavy fuel oil such as No. 6 oil is flowed to the burner at a metered rate which provides the required energy input to raise the temperature of the exhaust gas to the desired level. Steam or pressurized air is supplied to the burner to atomize the fuel oil and an off-stoichiometric amount of primary air is supplied to the burner in an amount just sufficient to sustain the flame. This minimizes the amount of air that is introduced into the duct and thereby enhances the efficiency of the heater because less cold air needs to be heated. Typically, the burner can be operated with an amount of primary air which supplies no more than 10 to 15% of the total oxygen requirement for a complete combustion of the fuel. The remainder of the necessary oxygen is obtained from the exhaust gas (or air) supplied to the trough via register 50 (or 76) and the passages communicating the interior of the register with the trough.

As the flame burns in the trough, the upstream sides 44 of the flame shields direct the gas stream into paths 46 between adjacent shields and between the outermost face shields and the horizontal duct walls 6. It will be observed that the exhaust gas paths 46 are of substantially uniform cross-section and since the peripheral flame portions 42 protrude equally into the paths over substantially their entire length, a uniform heating of the exhaust gas is attained. In addition, the gas flows over the parallel guide plates 30 of the face shields in a substantially laminar, turbulence-free flow and gently slips off the downstream ends of the guide plates. Simultaneously therewith gas from the burning flame, that is gas generated by the flame, the primary and the exhaust gas (or air) entering the register, flow from the trough in a downstream direction and intimately mix with the exhaust gas that has flowed through paths 46. As a result, there are virtually no eddies on the flame side 24 of the shields and a deposit of carbon or soot on the shields is thus prevented. This both enhances the efficiency of the heater and reduces the discharge of pollutants into the atmosphere.

At the same time, of course, the flame shield protects the flame from any substantial direct contact with the gas flow. Accordingly, a deflection of the flame in a downstream direction and a possible extinction of the flame from gases flowing at a high speed is prevented. Instead, the flame is permitted to burn substantially undisturbed by the gas flow. Further, the obliquely inclined register passages 66*a–e* direct the exhaust gas (or air) supplied to the flame in the direction in which the flame burns. This not only eliminates the danger of deflecting the flame in a downstream direction out of the trough, but tends to lengthen the flame so that it extends as far as possible into or across the duct. Under low burner loads when flames may become relatively short, this is particularly helpful to assure a uniform heating of the exhaust gas.

Figure 6:
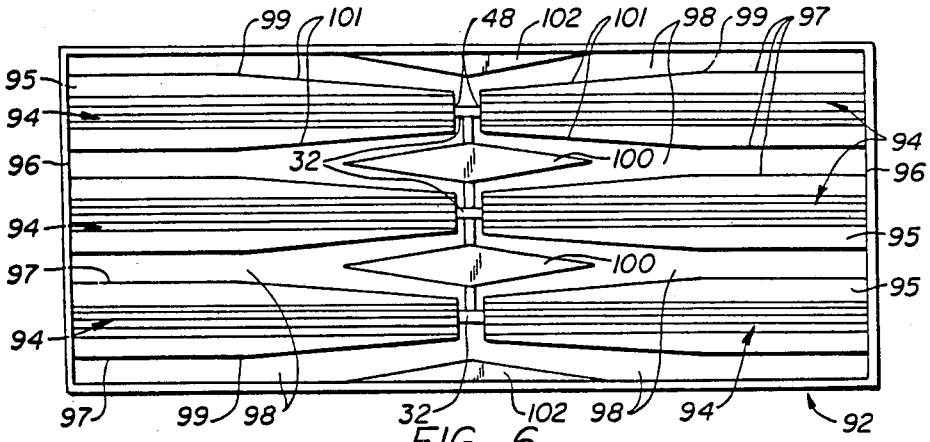
FIG. 6 is a front elevational view, in section, similar to FIG. 1 but illustrates an exhaust gas heater constructed in accordance with the present invention for use in connection with relatively wide exhaust gas ducts.

Referring now momentarily to FIG. 6, in another embodiment of the present invention adapted for use with exhaust gas ducts 92 which are too wide to be completely traversed by a flame, a plurality of burners and associated flame shields (collectively identified in FIG. 6 with reference numeral 94) are mounted in a common plane and in mutual alignment to opposite, vertical duct walls 96. The burners and shields are constructed as set forth above except that a base portion 95 of the shields may have parallel edges 97 from the associated duct wall to a point 99 spaced therefrom. From these points to free ends 48 of the shields shield edges 101 converge, i.e. they are tapered as is shown in FIG. 6. Parallel base edges for the shields are desirable for large ducts to prevent the shield bases from becoming too wide which would encourage the formation of undesirable eddies on the down stream side of the shields and further would make it necessary to form flames with relatively wide flame bases. Wide flame bases, on the other hand, are not normally conducive to the formation of long, pencil-shaped flames.

Further, irrespective of whether or not the shields include straight base portions 95 the free ends 48 of the shields might be relatively narrow due to the length of the shields so that the paths 98 between adjoining shields widen at the points at which the flames are narrowest. Consequently, the exhaust gas flowing through the center portions of the respective paths might be heated to a lesser extent than the portions of the gas flowing through the paths adjacent the duct sides so that the gas temperature may become nonuniform downstream of the heater. To avoid such a nonuniform heating, generally diamond-shaped baffle plates 100 are placed in the center portion of each path so as to reduce the cross-section of the path in that area to thereby correspondingly reduce the gas flow. In this manner, the heating of the gas flow over the entire length of the respective paths can be maintained substantially uniform.

The baffle plate may be mounted in any practical manner as, for example, by suitably attaching them to portions of support pipes 32 between opposing free ends 48 of the flame shields. Further, a half baffle plate 102 may be affixed to the center portion of the horizontal duct walls above and below the uppermost and the lowermost flame shields or the duct walls may be correspondingly contoured to limit the path cross-sections in the described manner. In all other respects, however, the exhaust gas heater 92 illustrated in FIG. 6 is constructed and functions in a manner analogous to that of heater 2 illustrated in FIGS. 1–4.

Figure 2:
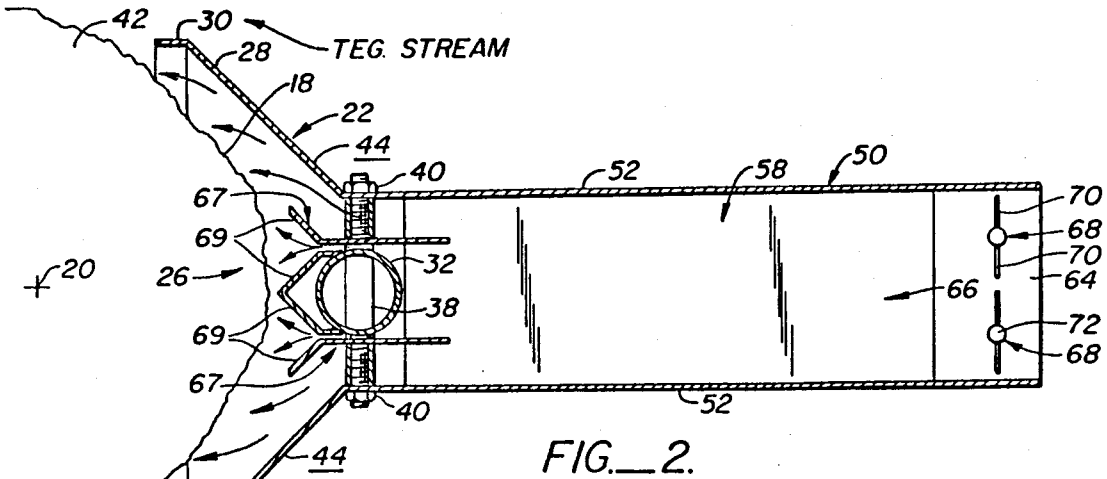
FIG. 2 is a cross-sectional side elevational view of a flame shield and a combustion oxygen supply register constructed in accordance with the present invention and is taken proximate the base of the shield and of the flame along line 2—2 of FIG. 1.
Figure 11:
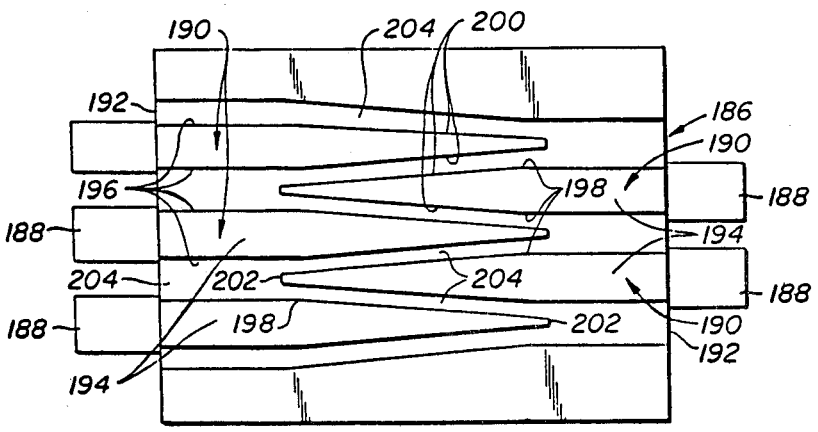
FIG. 11 is a view similar to FIG. 6 but illustrates an arrangement of the flame shields in accordance with a futher embodiment of the invention.

Referring momentarily to FIG. 11, in another embodiment of the invention best adapted for use in connection with ducts 186 of intermediate width, that is narrower than the ducts illustrated in FIG. 6 but wider than the duct shown in FIG. 2, a plurality of burners 188 and associated flame shields 190 are mounted to opposing duct walls 192 and arranged so that the shields interleaf. Each shield again includes a base section 194 which has parallel shield edges 196 that extend to a point 198. Tapered shield edges 200 converge from point 198 towards a free end 202 of the shield. To keep passageways 204 between the shield edges of approximately even heights, the tapered shield edges 200 of each shield extend two or slightly beyond the point 198 of the adjacent shield 190 mounted to the opposite duct wall 192. In this manner, a relatively even heating of the exhaust gas flowing through passageways 204 is again achieved without requiring undesirably wide shield bases.

Referring now to FIGS. 4 and 7–9, the exhaust gas heater of the present invention can be operated with any suitable burner which generates a flame of the desired shape, e.g. a relatively long and narrow flame. A particularly advantageous burner, however, is the low pressure burner 104 illustrated in FIGS. 7–9.

Typically, burners which form a long, narrow flame utilize high pressure (primary) air to sustain the combustion of atomized fuel particles and high pressure air to atomize or disburse the fuel since such high pressure air both increases the length of the flame and decreases its width. Such burners, however, require sources of high pressure air which are expensive, noisy and require frequent maintenance.

Figure 8:
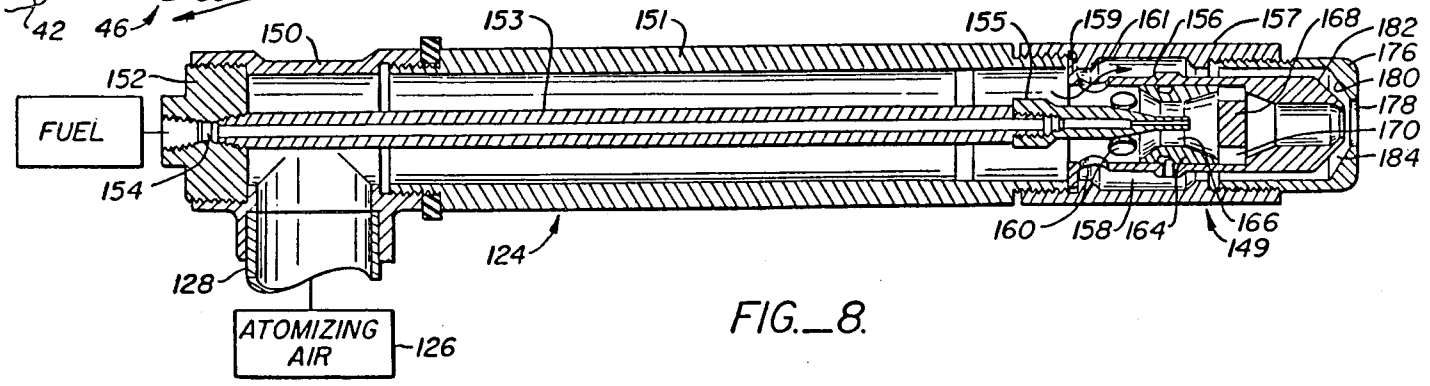
FIG. 8 is an enlarged, side elevational view of the nozzle utilized by the burner illustrated in FIG. 7.
Figure 9:
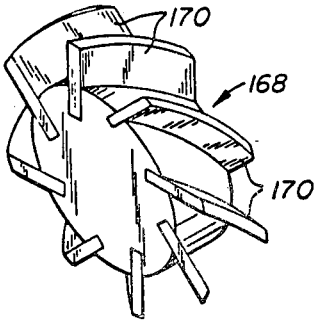
FIG. 9 is a perspective view of a swirl plate used in the nozzle illustrated in FIG. 8.
Figure 7:
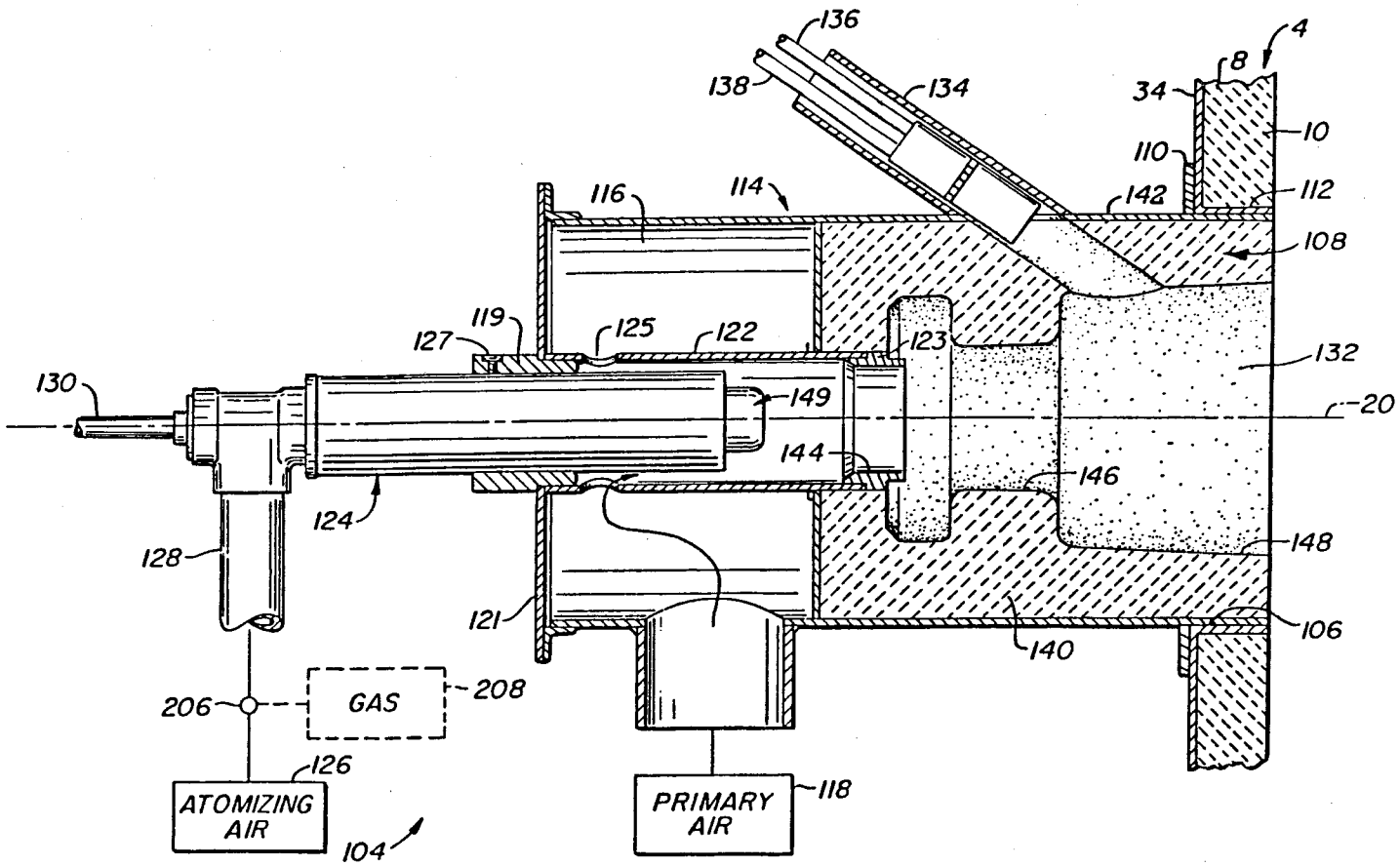
FIG. 7 is a fragmentary, side elevational view of a wall mounted burner utilized by the heater of the present invention.

In contrast thereto, the burner 104 illustrated in FIGS. 7–9 operates with low pressure air, yet it is capable of generating the relatively, narrow, pencil-shaped flame. Typically, the fuel atomizer of such a burner can be operated with air having a pressure no greater than about 4.5 psi above the ambient pressure while the primary air may have a pressure of no more than 0.3 psi above ambient pressure.

In a presently preferred embodiment of the invention, the low pressure burner 104 comprises a self-contained unit which can be inserted into an appropriately shaped opening 106 in upright duct walls 8. A forward end or throat 108 of the burner may be provided with an annular mounting flange 110 that is conventionally secured, e.g. bolted to the exterior duct plate 34. The opening may be lined with a metal sleeve 112 to facilitate the insertion and removal of the burner and to prevent damage to the refractory bricks 10. The burner further includes a housing 114 which projects rearwardly from the throat 108 and which defines a cylindrical primary air chamber 116 in fluid communication with a source of primary air 118 via a suitable flow control valve (not separately shown in FIGS. 7–9).

A liquid fuel atomizing gun 124 is slidably received in a sleeve 119 which extends through an aft cover plate 121 that closes the primary air chamber 116. An air guide tube 122 is disposed concentrically about the atomizing gun and extends from a portion of sleeve 119 protruding into the primary air chamber to a burner throat opening 132 in throat 108. A bushing 123 defines a downstream end of the air guide tube, extends into the throat opening and positions the air guide tube relative thereto. The air guide tube includes a plurality of air inlet apertures 125 located proximate chamber cover plate 121 so that primary air can flow from chamber 116 through inlet apertures 125 into the guide tube. In the guide tube the primary air flow is directionalized parallel to the atomizing gun 124 to avoid undesirable turbulence in the air and atomized fuel flow downstream of the atomizer which might occur if the primary air were deflected through 90° as would be the case if no air guide tube were provided. A more uniform, efficient and relatively emissionfree combustion of the fuel is thereby attained.

A set screw 127 or the like releasably secures the atomizing gun to sleeve 119. By backing off the set screw, the gun is readily withdrawn from the sleeve 119 and thereby from housing 114 for inspection, cleaning, maintenance and the like.

A source of atomizing air 126 such as a regenerative blower provides atomizing air through a conduit 128 to the atomizing gun. Heavy fuel oil such as No. 6 oil is fed to the gun via a tube 130. As is discussed in greater detail below, the atomizing gun forms a mixture of finely dispersed, minute droplets of liquid fuel entering the gun through tube 130 and atomizing air entering through conduit 128 and projects this mixture in a downstream direction through the downstream portion of air guide tube 122 and into the burner throat opening 132. The atomizing air source provides air at a relatively low pressure, generally no greater than about 4.5 psi above ambient pressure. Blowers providing air at pressures as low as 2.5 psi have been found to be sufficient.

An igniter or pilot 134 includes one or more supply tubes 136, 138 and projects into the burner throat opening 132 downstream of atomizing gun 124 to enable the ignition of the mixture and initate combustion. Once combustion has commenced, it is self-sustaining until the supply of fuel through tube 130 is terminated.

The burner throat opening 132 is defined by a refractory element 140 mounted within a sheetmetal housing 142. The opening is contoured over its longitudinal extent so that it forms at least two inwardly projecting steps 144 (in the illustrated embodiment defined by bushing 123) and 146 at a first, upstream stage of the throat. The steps induce eddies in the mixture and the primary air flowing through the throat which facilitate the intimate mixing of the mixture dispersed by atomizing gun 124 and the primary air. The throat opening 132 terminates in an expansion cone 148 which leads directly into the trough 26 (shown in FIG. 2).

The atomizing gun 124 comprises an oil atomizer 149 at a downstream end of the gun, a T-fitting 150 at an upstream end thereof, and an extension pipe 151 disposed between and threadably engaging the atomizer and the T-fitting so as to interconnect the two while spacing them apart.

A plug 152 threadably engages the upstream oriented opening of the T-fitting and it includes a fuel passage 154, the upstream end of which is threaded for connection to a correspondingly threaded end of fuel tube 130. The downstream end of fuel passage 154 is similarly threaded and threadably receives an end of a fuel supply conduit 153 which extends in a downstream direction to the vicinity of oil atomizer 149. The downstream end of the fuel conduit threadably mounts an oil discharge nozzle 155 which extends into the atomizer as is more fully described below.

The atomizer 149 comprises a generally cylindrical housing, the upstream end of which is threaded onto the downstream end of extension pipe 151. A generally cylindrical, tubular central core member 156 includes a radially outwardly protruding flange 159 at its upstream end which is clamped between the opposing surfaces defined by the downstream end of the extension pipe 151 and an inwardly protruding ridge 161 of the housing 157 so that the interior of the core member is in fluid communication with the interior of extension pipe 151. The core member includes a plurality of apertures 160 adjacent an upstream end thereof to permit atomizing air from air source 126 to flow via the fitting 150, the interior of extension pipe 151 and the interior of core member 156 into an annular passage 158 between the exterior of the core member and the interior of housing 157. As is set forth in greater detail below, part of the air flowing into the interior of core member continues through the core member in a downstream direction.

A hollow insert 164 is disposed within core member 156 and forms a venturi section 166 where the fuel oil issuing from nozzle 155 is mixed with the atomizing air.

A stationary swirl plate 168 (shown in detail in FIG. 9) is disposed within core member 156 and facilitates the mixing of fuel oil with the atomizing air. The swirl plate has a plurality of circumferentially disposed vanes 170 which impart a swirling motion to the mixture.

A cap 176 threadably engages the downstream end of the housing 157 and includes a co-axial aperture 178 which extends from the exterior of the cap to an interior, tapered surface 180. The downstream end of core member 156 is provided with a corresponding, inwardly tapered surface 182 which cooperates with tapered cap surface 110 to form a radially inwardly converging passageway 184 which communicates with the annular passage 158. Consequently, atomizing air not only enteres venturi section 166, but a secondary supply of atomizing air is provided through apertures 160 into the inclined passageway 184. This secondary supply of atomizing air provides an "air cushion" at the tip of the atomizer and minimizes the fouling of the atomizer tip by fuel oil deposits.

In operation, low pressure primary air from primary air source 118 continuously flows through air-chamber 116 of housing 114 guide tube apertures 125 and guide tube 122 into burner throat 132. The fuel oil-atomizing air mixture is injected into the stream of primary air in the guide tube along burner axis 20 and just upstream of the throat opening.

The mixture ignites within flame throat 132. The steps 144, 146 induce a sequence of longitudinally spaced eddies which enhance the mixing of the fuel oil-atomizing air mixture with primary air to obtain satisfactory combustion.

As was discussed earlier, the amount of primary air and atomizing air is selected so that it is just sufficient to sustain the combustion of the fuel. In a typical case in which the exhaust gas flowing through duct 4 comprises turbine exhaust gas having an oxygen content of approximately 14%, the primary and atomizing air flows are regulated so that they each supply between about 10 to about 15% of the overall oxygen requirement for the complete combustion of all fuel introduced through the burner. The remainder of the necessary combustion oxygen is obtained from the turbine exhaust gas (or combustion air) directed to the flame trough 26 via register 50 and passages 66 as was described above.

The atomizing gun 124 of the present invention is particularly well adapted for use with wall mounted duct burners. As above indicated, its elongate configuration makes it possible to insert the gun axially through the cover plate 121 of primary air chamber 116. This greatly facilitates the ease with which the axial position of the atomizer 149 is adjusted as well as the maintenance, cleaning and replacement of the atomizer if and when that is required. Although such a construction makes it necessary to feed primary air into the chamber 116 generally transversely to the flame direction, the provision of the primary air guide tube 122 directionalizes the primary air flow parallel to the flame before it contacts the atomized fuel mixture and thereby prevents adverse effects which might otherwise be encountered due to turbulence and the like in the vicinity of the atomizer. Further, the atomizer in conjunction with the above-described configuration of the burner throat 132 yields an elongate, pencil-shaped flame which reaches deep into the duct 4 while the nozzle can be operated with relatively very low atomizng and primary air pressures. This in turn reduces the complexity of the air supply and, thereby, the overall costs of the heater.

For instances in which it may become desirable to operate the duct heater from time to time with gas, or to supplement the oil firing of the heater with gaseous fuel (hereinafter "gas") to help accommodate peak loads or for other reasons, the burner 104 illustrated in FIGS. 7 and 8 can be operated as a gas burner, or as a combined oil and gas burner by providing a valve 206 which alternatively connects conduit 128 with the atomizing air source 126 or with a gas source 208. If, for example, the burner is operated with oil and it is desired to augment the fuel supply with gas, valve 206 can be operated to connect conduit 128 with the gas source. In such an event, the fuel oil entering the oil atomizer 149 is atomized with gas rather than air. Corresponding adjustments in the supply of primary air from air source 118 must, of course, be made in a conventional manner.

Further, the burner 104 may be switched over to gas operation only again by operating valve 206 to connect conduit 128 with gas source 208. At the same time, the fuel oil supply is turned off so that any residual oil entering the oil atomizer 149 is atomized by gas but the burner as a whole thereafter continues to be fired by gas only.

As advantage of this arrangement is that it not only enables the substitution of one fuel for another, but that the substitution can be accomplished without interruption in the firing of the burner.

Figure 10:
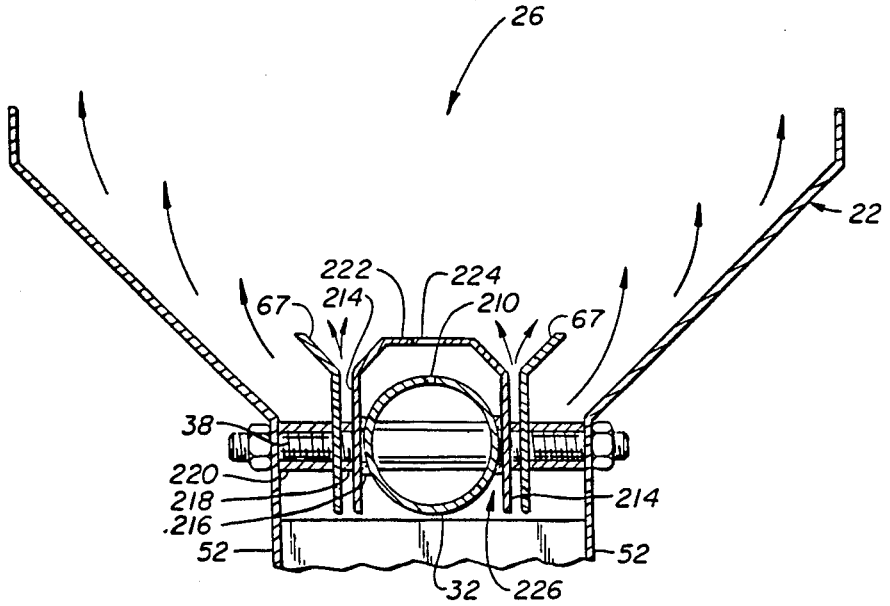
FIG. 10 is a schematic side elevational view, in section, of a flame shield similar to the one illustrated in FIG. 2 but capable of being fired with gas.

Referring now to FIG. 10, in a further alternative for firing the duct heater with gas as a substitute for or augmentation of the oil firing burner, shield support pipe 32 may be utilized as a gas supply conduit by appropriately connecting the tube to a source of gas (not shown in FIG. 10). The downstream facing side of the support tube is provided with a multiplicity of gas discharge openings 210 which are distributed over the length of the pipe. A U-shaped flame stabilizer 212 is placed over the gas supply-shield support pipe 32. The stabilizer is defined by a pair of parallel legs 214 secured to studs 38 and appropriately spaced from the pipe, diffusers 67 and horizontal shield plates 52 with appropriately dimensioned bushings 216, 218 and 220 which are placed over the stud. A web 222 interconnecting the stabilizer legs 214 faces in a downstream direction and includes gas discharge apertures 224 which are of a larger diameter than the gas discharge openings in pipe 32 so as to permit gas to progress unimpededly from the pipe past the stabilizer into the trough 26 defined by flame shield 22. The stabilizer is constructed so that a space 226 between support pipe 32 and stabilizer legs 214 permits a primary combustion air flow for mixing the flow with gas issuing from gas discharge openings 210 before the resulting mixture exits from gas discharge apertures 224 in the stabilizer.

In all other respects the flame shield illustrated in FIG. 10 is constructed and operates in the same manner in which the flame shields illustrated in FIGS. 1–5 as constructed and operate except, of course, that the firing may alternatively be done with oil or gas or the oil firing may be augmented with gas firing if and when such augmentation appears desirable.

Referring now to FIGS. 5 and 12–14, when the exhaust gas flowing through the duct has an insufficient oxygen content to sustain the flame it is necessary to provide secondary combustion air from supply 86 via register 76 and hence into trough 26 defined by the flame shield 22 as was described in greater detail above. The relative proportion of secondary combustion air to the theoretically required amount of air for fully combusting the fuel injected by the burner which is introduced through plenum 26 may vary from one application to the next. However, in view of the oxygen deficiency in the gas stream, it is normally necessary to flow a major portion of the theoretically required air through the plenum and into the trough. In instances in which the secondary combustion air also performs a cooling function, as much as 100% of the theoretically required amount of air to combust the injected fuel must be flowed through the register and hence into the trough.

Assuming that such a condition exists, an upstream portion 230 of flame 18 has sufficient oxygen to combust the fuel therein. However, problems are encountered in a downstream portion 232 of the flame because the secondary combustion air is discharged relatively remote from this flame portion. Turbulence in trough 26 of the flame shield can lead to a sufficient dilution of the secondary combustion as in the upstream portion of the flame to prevent an effective and intimate mixing of the fuel with still available oxygen from the secondary combustion air. As a consequence, without more fuel particles in the upstream portion of the flame can dissipate into the gas stream before they can be combusted, thereby creating unacceptable pollutants which foul surfaces downstream of the heater and which are ultimately discharged as pollutants into the atmosphere.

To overcome this problem a substantial amount of primary combustion air over and above the theoretically necessary amount is provided by the burner. In the above example, which utilizes 100% stoichiometric air as secondary combustion air, the burner provides primary air in the amount of approximately 65% of the amount of air theoretically required by the entire flame. The primary air from the burner is biased in a downstream direction so that the downstream flame portion 232 receives more primary air than the upstream flame portion 230. In the sepcific example primary air is biased so that the downstream flame portion, which extends over an arc (which is concentric with respect to the burner axis 20) of approximately 160°, receives at least about 90% and preferably about 95% of the theoretically required amount of combustion air from the primary air. The remainder of the oxygen required in the downstream portion of the flame is supplied from secondary air which propagates from the flame shield 22 in a downstream direction.

In this manner, all fuel particles are fully combusted before they enter the exhaust gas stream through the duct. It has been determined that in low oxygen (2–3%) exhaust gas streams, primary air in the downstream portion of the flame in an amount less than about 90% of the amount of air that is theoretically required leads to an incomplete combustion and a resulting fouling of surfaces and discharge of pollutants.

To achieve the required "biasing" of the primary air, a burner 234 is provided which generally comprises a nozzle 236 for atomizing fuel oil which is concentric with respect to the burner axis 20. The nozzle terminates in the vicinity of a burner throat 238 that includes an opening 240 communicating the nozzle with the interior of the duct. The burner has a register 242 connected with a source of primary air (not shown in FIGS. 12–14). A central tube 224 surrounds the nozzle and has perforations 246 through which primary air can enter in surrounding relation to the nozzle for flow with the atomized fuel discharged by the nozzle through throat opening 240 into the duct.

The burner throat further has a plurality of spaced apart air biasing conduits 248 which communicate with register 242 and terminate in angularly inclined end sections 250. The conduits are arranged concentrically with respect to the burner axis and extend over an arc approximately equal to the arc over which the downstream flame portion 232 extends, i.e. over an arc of no more than 180° and typically over an arc of about 160°.

In operation the burner forms a flame 18 in a conventional manner and directs biasing air through conduits 248 into the downstream portion of the flame. The end sections 250 are obliquely inclined with respect to burner axis 20 and direct the biasing air towards the flame shield (not shown in FIGS. 12–14). This presses the flame towards the shield, helps to anchor it to the shield, and thus prevents the flame from migrating downstream into the gas flow through the duct.

Figure 14:
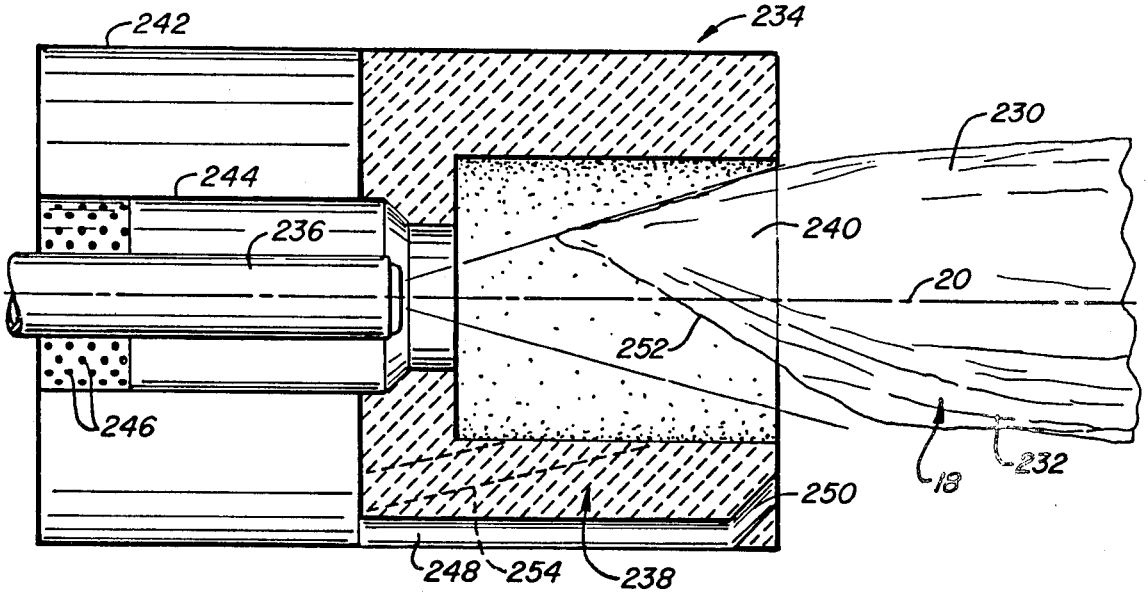
FIG. 14 is a side elevational view, in section, and is taken on line 14—14 of FIG. 13.
Figure 12:
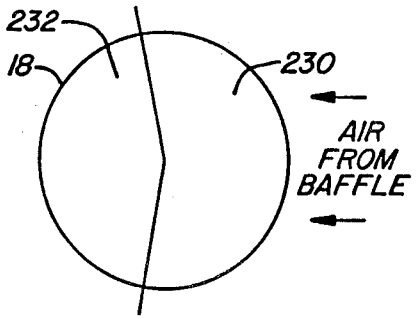
FIG. 12 is a schematic, cross-sectional representation of a flame generated by the exhaust gas heater of the present invention and the source of oxygen in the upstream and downstream portions of the flame as provided in accordance with another embodiment of the invention.

The biasing air is entrained in the flame, causes the flame front 252 to extend forwardly as is illustrated in FIG. 14, and provides the downstream portion of the flame with the additional combustion air as was discussed above. In a typical installation, in which air is utilized for atomizing the fuel, the primary air provided by burner 234 comprises approximately 65% of the theoretical, overall air required by the flame and is introduced as follows. Approximately 15% is introduced via the nozzle as fuel atomizing air, approximately 33% is introduced via central tube 244 concentrically about the discharged fuel, and 17% (for a total of 65% primary air) is introduced via biasing conduits 248 into the upstream portion of the flame.

Figure 13:
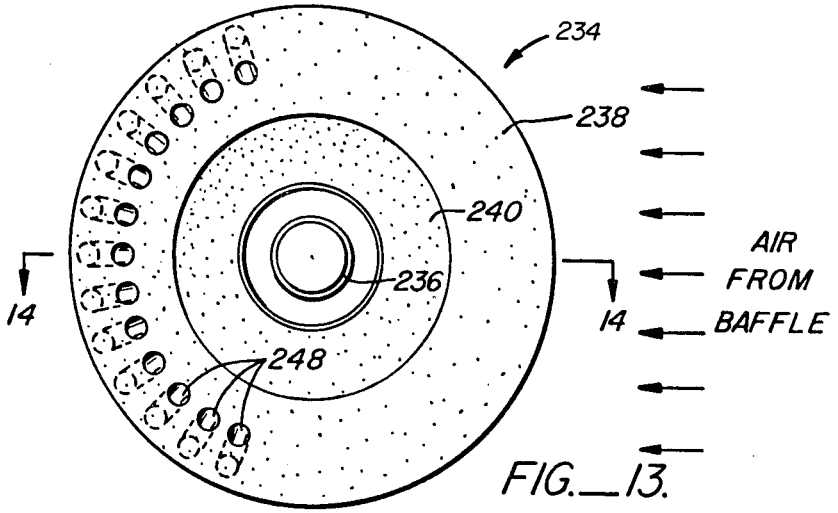
FIG. 13 is a front elevational view of a burner constructed in accordance with the embodiment of the invention in which primary combustion air is biased towards the downstream portion of the flame.

Of course, the exact arrangement of the biasing conduits 248 is not limited to the arrangement and positioning of the conduits as shown in FIGS. 13 and 14. For example, the biasing conduits may be arranged so that they terminate in the flame opening 240 of burner throat 238 as is indicated by phantom lines 254 in FIG. 14.

Figure 15:
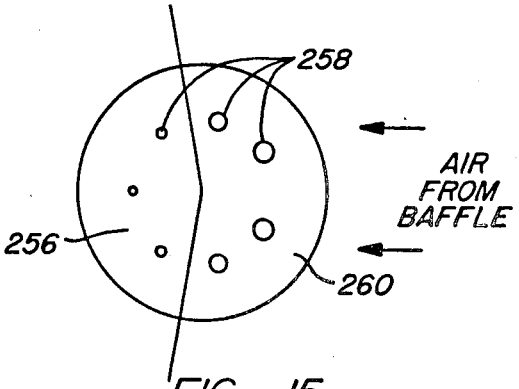
FIG. 15 is a schematic, front elevational view of an oil nozzle cap constructed in accordance with the present invention for directing relatively more fuel into an upstream portion of the flame.

Referring momentarily to FIG. 15, instead of biasing additional primary air into the upstream portion of the flame, the primary air can be concentrically discharged and additional fuel can be biased into the downstream portion 230 of the flame. For example, in instances in which the nozzle includes a nozzle cap 256 having mulitple fuel discharge openings 258, additional openings can be provided in the upsteam sector 260 of the cap which direct fuel into the upstream portion 230 of the flame. Alternatively, openings in the upstream sector of the cap can be drilled relatively larger. As a result, a greater amount of fuel is directed into the upstream flame portion than the downstream portion and the fuel to combustion oxygen ratio between the two flame portions is substantially equalized. This embodiment provides substantially the completeness of combustion as when primary air is biased into the downstream flame portion.

We claim:

1. A method for heating an exhaust gas flow through a duct defined by opposing duct walls comprising the steps of: generating an elongated flame with a fuel and an off-stoichiometric amount of primary combustion air; extending the flame from one duct wall towards the other duct wall; flowing exhaust gas in the form of exhaust gas streams about the flame along paths boundaries of which substantially intersect peripheries of the flame; flowing secondary combustion air transversely to and directly into an upstream portion of the flame, relative to the gas flow through the duct, over substantially the full length of the flame; equalizing the fuel-to-combustion air ratio in an upstream portion and in the downstream portion of the flame relative to the gas flow through the duct to thereby substantially uniformly and completely combust all fuel.

2. A method according to claim 1 wherein the step of equalizing comprises the step of biasing relatively more fuel into the upstream portion of the flame than into the downstream portion thereof.

3. A method according to claim 1 wherein the step of equalizing comprises the step of biasing relatively more primary combustion air into the downstream portion of the flame than into the upstream portion thereof.

* * * * *